US008028547B2

(12) United States Patent
Suzuki et al.

(10) Patent No.: US 8,028,547 B2
(45) Date of Patent: Oct. 4, 2011

(54) WARP KNITTED FABRIC, METHOD OF MANUFACTURING THE SAME, AND KNIT STRUCTURE OF WARP KNITTED FABRIC

(75) Inventors: Hiroyuki Suzuki, Sakai (JP); Ryuzo Suzuki, Sakai (JP); Yuko Sumitomo, Kyoto (JP); Sachie Nakase, Kyoto (JP)

(73) Assignee: Wacoal Corp., Kyoto-shi, Kyoto (JP)

( * ) Notice: Subject to any disclaimer, the term of this patent is extended or adjusted under 35 U.S.C. 154(b) by 0 days.

(21) Appl. No.: 12/990,537

(22) PCT Filed: Apr. 24, 2009

(86) PCT No.: PCT/JP2009/058180

§ 371 (c)(1),
(2), (4) Date: Nov. 24, 2010

(87) PCT Pub. No.: WO2009/133821

PCT Pub. Date: Nov. 5, 2009

(65) Prior Publication Data

US 2011/0056248 A1 Mar. 10, 2011

(30) Foreign Application Priority Data

May 2, 2008 (JP) ..... 2008-120651

(51) Int. Cl.
*D04B 23/06* (2006.01)

(52) U.S. Cl. ..... 66/192; 66/195

(58) Field of Classification Search ..... 66/195, 66/192, 193, 84 R, 85 R, 203
See application file for complete search history.

(56) References Cited

U.S. PATENT DOCUMENTS

| | | | | |
|---|---|---|---|---|
| 4,748,078 | A | 5/1988 | Doi et al. | |
| 5,172,570 | A * | 12/1992 | Wade et al. | 66/195 |
| 5,711,169 | A * | 1/1998 | Leeke et al. | 66/196 |
| 6,276,177 | B1 * | 8/2001 | West | 66/192 |
| 6,276,178 | B1 * | 8/2001 | West et al. | 66/193 |
| 6,305,196 | B1 * | 10/2001 | Takeshita et al. | 66/195 |
| 6,314,768 | B2 * | 11/2001 | Motoya | 66/85 R |
| 6,401,497 | B1 * | 6/2002 | Nishiyama et al. | 66/172 E |
| 6,446,472 | B2 * | 9/2002 | West et al. | 66/193 |
| 6,971,252 | B2 * | 12/2005 | Therin et al. | 66/170 |
| 7,028,510 | B1 * | 4/2006 | DaRosa | 66/190 |
| 2009/0172858 | A1 | 7/2009 | Oya et al. | |

FOREIGN PATENT DOCUMENTS

JP 2-202743 5/1990

(Continued)

OTHER PUBLICATIONS

Japanese Office Action in JP Application P2008-120651 issued Jun. 28, 2011.

*Primary Examiner* — Danny Worrell
(74) *Attorney, Agent, or Firm* — Leydig, Voit & Mayer, Ltd.

(57) ABSTRACT

A warp knitted fabric having the isotropy of strength. The warp knitted fabric is provided with a fabric weave and insertion yarn groups (14, 16). The insertion yarn group (14) comprises four yarns (Y4*a*-Y4*d*) of the same type. The insertion yarn group (16) comprises four yarns (Y5*a*-Y5*d*) of the same type. The yarns (Y4*a*-Y4*d*, Y5*a*-Y5*d*) are inserted into a warp-knitted fabric weave in the warp direction while being arranged parallel to each other at an interval of one wale in the weft direction. Each of the yarns (Y4*a*-Y4*d*, Y5*a*-Y5*d*) comprises a portion (14*a*) extending as a whole in the direction crossing the warp direction, a portion (14*b*) extending as a whole in the direction crossing the warp direction, and a portion (14*c*) extending as a whole in the direction extending along the warp direction and connecting the portions (14*a*, 14*b*) to each other. One of the yarns (Y4*a*-Y4*d*) is overlapped with a corresponding one of the yarns (Y5*a*-Y5*d*) when viewed from the thickness direction.

6 Claims, 15 Drawing Sheets

FOREIGN PATENT DOCUMENTS

| | | |
|---|---|---|
| JP | 7-020977 | 4/1995 |
| JP | 9-059854 | 3/1997 |
| JP | 2000-8203 | 1/2000 |
| JP | 2001-303414 | 10/2001 |
| JP | 2002-146655 | 5/2002 |
| JP | 3-3023354 | 10/2003 |
| JP | 2003-301354 | 10/2003 |
| JP | 3-120829 | 3/2006 |
| JP | 2007-113125 | 5/2007 |
| JP | 3136451 | 10/2007 |

* cited by examiner

*Fig.7*

| | LOAD FOR STRETCHING (IN FIRST STRETCH) | | | TIGHTENING FORCE (IN FIRST STRETCH) | | |
|---|---|---|---|---|---|---|
| | WARP DIRECTION [cN] | BIAS DIRECTION [cN] | WEFT DIRECTION [cN] | WARP DIRECTION [cN] | BIAS DIRECTION [cN] | WEFT DIRECTION [cN] |
| EXAMPLE 1 | 186 | 166 | 90 | 87 | 81 | 43 |
| EXAMPLE 2 | 151 | 111 | 68 | 77 | 58 | 29 |
| COMPARATIVE EXAMPLE | 198 | 152 | 271 | 152 | 62 | 74 |

*Fig.8*

| | LOAD FOR STRETCHING (IN THIRD STRETCH) | | | TIGHTENING FORCE (IN THIRD STRETCH) | | |
|---|---|---|---|---|---|---|
| | WARP DIRECTION [cN] | BIAS DIRECTION [cN] | WEFT DIRECTION [cN] | WARP DIRECTION [cN] | BIAS DIRECTION [cN] | WEFT DIRECTION [cN] |
| EXAMPLE 1 | 116 | 106 | 61 | 80 | 75 | 39 |
| EXAMPLE 2 | 97 | 75 | 43 | 71 | 53 | 26 |
| COMPARATIVE EXAMPLE | 162 | 93 | 140 | 147 | 54 | 64 |

*Fig.9*

| | LOAD FOR STRETCHING (IN FIRST STRETCH) [cN] | LOAD FOR STRETCHING (IN THIRD STRETCH) [cN] | TIGHTENING FORCE (IN FIRST STRETCH) [cN] | TIGHTENING FORCE (IN THIRD STRETCH) [cN] |
|---|---|---|---|---|
| EXAMPLE 1 | 41.35 | 23.92 | 19.48 | 18.26 |
| EXAMPLE 2 | 33.89 | 22.17 | 19.74 | 18.49 |
| COMPARATIVE EXAMPLE | 49.00 | 28.78 | 39.90 | 41.68 |

WARP KNITTED FABRIC, METHOD OF MANUFACTURING THE SAME, AND KNIT STRUCTURE OF WARP KNITTED FABRIC

TECHNICAL FIELD

The present invention relates to a warp knitted fabric, a method of manufacturing the same, and a knit structure of a warp knitted fabric.

BACKGROUND ART

There is a conventionally known garment (girdle) having belt-like tightening portions (e.g., cf. Patent Literature 1 below). The tightening portions are knitted by a warp knitting machine in such a manner that portions with a relatively strong tightening force and portions with a relatively weak tightening force switch in the longitudinal direction thereof. The portions with the relatively strong tightening force of the tightening portions are located at positions corresponding to front center areas of wearer's thighs when a wearer wears the girdle. The portions with the relatively weak tightening force of the tightening portions are located so as to surround the thighs in regions except for the front center areas of the thighs when the wearer wears the girdle. For this reason, the portions with the relatively strong tightening force strongly tighten the wearer's quadricepses while the portions with the relatively strong tightening force and the portions with the relatively weak tightening force adequately tighten the wear's entire thighs; therefore, the wearer can kick legs to full extension during walking while keeping an excellent shape.

There is another conventionally known garment (girdle) having portions with a relatively strong tightening force and portions with a relatively weak tightening force (e.g., cf. Patent Literature 2 below). This girdle comprises a warp knitted fabric having belt-like and curved continuous patterns of the portions with the relatively strong tightening force and the portions with the relatively weak tightening force. In the girdle, the belt-like and curved portions with the relatively strong tightening force and with the relatively weak tightening force are arranged from below bulges of buttocks to sides. For this reason, the portions with the relatively strong tightening force and with the relatively weak tightening force provide the girdle with a function of lifting the buttocks so as to keep the buttocks in shape.

Furthermore, there is a conventionally known warp knitted fabric configured so that patterns are knitted along with a ground structure comprising a series of loops in the warp direction (e.g., cf. Patent Literature 3 below). This warp knitted fabric has plural types of ground knit regions different in weft-directional swings of elastic yarns inserted in the loops, and the plural types of ground knit regions are repeatedly continued in the warp direction.

CITATION LIST

Patent Literature

Patent Literature 1: Japanese Patent Application Laid-open Publication No. 2007-113125

Patent Literature 2: Japanese Patent No. 3023354 (Japanese Patent Application Laid-open Publication No. 2000-008203)

Patent Literature 3: Japanese Registered Utility Model No. 3136451

SUMMARY OF INVENTION

Technical Problem

Incidentally, the warp knitted fabric generally tended to have smaller strength in directions crossing the warp and weft directions (i.e., in bias directions) than that (magnitude of stretching force and magnitude of tightening force) in the warp and weft directions. Namely, the conventionally ordinary warp knitted fabrics had anisotropy of strength.

It is, however, preferable in some cases that the strength of the warp knitted fabric be uniform regardless of directions or that the strength be isotropic, depending upon uses of the warp knitted fabric. Specific examples of such uses include garments (underwear) that are required to have stretchability (extensibility) and that are worn in a tight-fitting state to the body.

It is therefore an object of the present invention to provide a warp knitted fabric capable of exhibiting isotropy of strength, a method of manufacturing the warp knitted fabric, and a knit structure of a warp knitted fabric.

Solution to Problem

A warp knitted fabric according to the present invention is one comprising: ground yarns constituting a ground structure by warp knitting; and a primary insert yarn group comprising first to Nth, wherein N is a natural number of not less than 2, primary insert yarns and a secondary insert yarn group comprising first to Nth secondary insert yarns, which are inserted along a warp direction in the ground structure to be knitted with the ground structure, thereby constituting an insertion structure, wherein the first to Nth primary insert yarns and the first to Nth secondary insert yarns are arranged side by side in a weft direction, wherein the nth, wherein n is a natural number of 1 to N, primary insert yarn and the nth secondary insert yarn have respective, first portions knitted in the ground structure while becoming closer to each other in the warp direction, second portions knitted in the ground structure while becoming farther away from each other in the warp direction, and curved portions each of which connects the associated first portion and second portion, wherein the first portion, the second portion, and the curved portion of each insert yarn as a whole form a meandering shape, and wherein the curved portion of the nth primary insert yarn and the curved portion of the nth secondary insert yarn overlap each other when viewed from a thickness direction.

A method of manufacturing a warp knitted fabric according to the present invention is one comprising: a step of forming a ground structure by warp knitting of ground yarns and inserting first to Nth, wherein N is a natural number of not less than 2, primary insert yarns to constitute a primary insert yarn group and first to Nth secondary insert yarns to constitute a secondary insert yarn group, each along a warp direction in the ground structure to knit the insert yarns with the ground structure, thereby forming an insertion structure, wherein the first to Nth primary insert yarns and the first to Nth secondary insert yarns are arranged side by side in a weft direction, wherein the nth, wherein n is a natural number of 1 to N, primary insert yarn and the nth secondary insert yarn have respective, first portions knitted in the ground structure while becoming closer to each other in the warp direction, second portions knitted in the ground structure while becoming farther away from each other in the warp direction, and curved portions each of which connects the associated first portion and second portion, wherein the first portion, the second portion, and the curved portion of each insert yarn as a whole form a meandering shape, and wherein the curved portion of the nth primary insert yarn and the curved portion of the nth secondary insert yarn overlap each other when viewed from a thickness direction.

A knit structure of a warp knitted fabric according to the present invention is one comprising: ground yarns constituting a ground structure by warp knitting; and a primary insert yarn group comprising first to Nth, wherein N is a natural number of not less than 2, primary insert yarns and a secondary insert yarn group comprising first to Nth secondary insert yarns, which are inserted along a warp direction in the ground structure to be knitted with the ground structure, thereby constituting an insertion structure, wherein the first to Nth primary insert yarns and the first to Nth secondary insert yarns are arranged side by side in a weft direction, wherein the nth, wherein n is a natural number of 1 to N, primary insert yarn and the nth secondary insert yarn have respective, first portions knitted in the ground structure while becoming closer to each other in the warp direction, second portions knitted in the ground structure while becoming farther away from each other in the warp direction, and curved portions each of which connects the associated first portion and second portion, wherein the first portion, the second portion, and the curved portion of each insert yarn as a whole form a meandering shape, and wherein the curved portion of the nth primary insert yarn and the curved portion of the nth secondary insert yarn overlap each other when viewed from a thickness direction.

In the warp knitted fabric, the method of manufacturing the warp knitted fabric, and the knit structure of the warp knitted fabric according to the present invention, the first to Nth primary insert yarns and the first to Nth secondary insert yarns are inserted along the warp direction in the ground structure and each of the nth primary insert yarn and the nth secondary insert yarn is formed as a whole in the meandering shape of the first portion, the second portion, and the curved portion. For this reason, the strength of the warp knitted fabric is ensured in the warp direction. In the warp knitted fabric, the method of manufacturing the warp knitted fabric, and the knit structure of the warp knitted fabric according to the present invention, the first to Nth primary insert yarns and the first to Nth secondary insert yarns each are knitted in the ground structure so that the curved portion of the nth primary insert yarn and the curved portion of the nth secondary insert yarn overlap each other when viewed from the thickness direction. For this reason, the nth primary insert yarn and the nth secondary insert yarn are connected at their respective curved portions through the ground structure, the first portion of the nth primary insert yarn and the second portion of the nth secondary insert yarn form a line extending as if it is continuous in a bias direction (direction crossing the warp and weft directions), and the second portion of the nth primary insert yarn and the first portion of the nth secondary insert yarn form a line extending as if it is continuous in a bias direction. Therefore, the strength is ensured in the bias and weft directions. As a consequence, the fabric is able to exhibit isotropy of strength.

Another warp knitted fabric is one comprising: ground yarns constituting a ground structure by warp knitting; and a primary knit yarn group comprising first to Nth, wherein N is a natural number of not less than 2, primary knit yarns and a secondary knit yarn group comprising first to Nth secondary knit yarns, which are knitted along a warp direction with the ground structure, thereby constituting a looping structure, wherein the first to Nth primary knit yarns and the first to Nth secondary knit yarns are arranged side by side in a weft direction, wherein the nth, wherein n is a natural number of 1 to N, primary knit yarn and the nth secondary knit yarn have respective, first portions knitted in the ground structure while becoming closer to each other in the warp direction, second portions knitted in the ground structure while becoming farther away from each other in the warp direction, and curved portions each of which connects the associated first portion and second portion, wherein the first portion, the second portion, and the curved portion of each knit yarn as a whole form a meandering shape, and wherein the curved portion of the nth primary knit yarn and the curved portion of the nth secondary knit yarn overlap each other when viewed from a thickness direction.

Another method of manufacturing a warp knitted fabric according to the present invention is one comprising: a step of forming a ground structure by warp knitting of ground yarns and knitting first to Nth, wherein N is a natural number of not less than 2, primary knit yarns to constitute a primary knit yarn group and first to Nth secondary knit yarns to constitute a secondary knit yarn group, each along a warp direction with the ground structure, thereby forming a looping structure, wherein the first to Nth primary knit yarns and the first to Nth secondary knit yarns are arranged side by side in a weft direction, wherein the nth, wherein n is a natural number of 1 to N, primary knit yarn and the nth secondary knit yarn have respective, first portions knitted in the ground structure while becoming closer to each other in the warp direction, second portions knitted in the ground structure while becoming farther away from each other in the warp direction, and curved portions each of which connects the associated first portion and second portion, wherein the first portion, the second portion, and the curved portion of each knit yarn as a whole form a meandering shape, and wherein the curved portion of the nth primary knit yarn and the curved portion of the nth secondary knit yarn overlap each other when viewed from a thickness direction.

A knit structure of a warp knitted fabric according to the present invention is one comprising: ground yarns constituting a ground structure by warp knitting; and a primary knit yarn group comprising first to Nth, wherein N is a natural number of not less than 2, primary knit yarns and a secondary knit yarn group comprising first to Nth secondary knit yarns, which are knitted along a warp direction with the ground structure, thereby constituting a looping structure, wherein the first to Nth primary knit yarns and the first to Nth secondary knit yarns are arranged side by side in a weft direction, wherein the nth, wherein n is a natural number of 1 to N, primary knit yarn and the nth secondary knit yarn have respective, first portions knitted in the ground structure while becoming closer to each other in the warp direction, second portions knitted in the ground structure while becoming farther away from each other in the warp direction, and curved portions each of which connects the associated first portion and second portion, wherein the first portion, the second portion, and the curved portion of each knit yarn as a whole form a meandering shape, and wherein the curved portion of the nth primary knit yarn and the curved portion of the nth secondary knit yarn overlap each other when viewed from a thickness direction.

In the warp knitted fabric, the method of manufacturing the warp knitted fabric, and the knit structure of the warp knitted fabric according to the present invention, the first to Nth primary knit yarns and the first to Nth secondary knit yarns are knitted along the warp direction with the ground structure and each of the nth primary knit yarn and the nth secondary knit yarn is formed as a whole in the meandering shape of the first portion, the second portion, and the curved portion. For this reason, the strength of the warp knitted fabric is ensured in the warp direction. In the warp knitted fabric, the method of manufacturing the warp knitted fabric, and the knit structure of the warp knitted fabric according to the present invention, the first to Nth primary knit yarns and the first to Nth secondary knit yarns each are knitted in the ground structure so that the curved portion of the nth primary knit yarn and the curved portion of the nth secondary knit yarn overlap each other when viewed from the thickness direction. For this reason, the nth primary knit yarn and the nth secondary knit yarn are connected at their respective curved portions through the ground structure, the first portion of the nth primary knit yarn and the second portion of the nth secondary knit yarn form a line extending as if it is continuous in a bias direction (direction crossing the warp and well directions), and the second portion of the nth primary knit yarn and the first portion of the nth secondary knit yarn form a line extending as if it is continuous in a bias direction. Therefore, the strength is ensured in the bias and well directions. As a consequence, the fabric is able to exhibit isotropy of strength.

Advantageous Effects of Invention

The present invention successfully provides the warp knitted fabrics capable of exhibiting the isotropy of strength, the methods of manufacturing the warp knitted fabrics, and the knit structures of the warp knitted fabrics.

BRIEF DESCRIPTION OF DRAWINGS

FIG. 7 is a table showing values of load for stretching and tightening force in the first stretch.

FIG. 8 is a table showing values of load for stretching and tightening force in the third stretch.

FIG. 9 is a table showing standard deviations in Examples 1, 2 and Comparative Example, of load for stretching and tightening force in the first and third stretches.

DESCRIPTION OF EMBODIMENTS

A preferred embodiment of warp knitted fabric 10 according to the present invention will be described with reference to the drawings. The warp knitted fabric 10 of the present embodiment can be manufactured, for example, using the Jacquard raschel knitting machine RSJ5/1EL available from Karl Mayer.

Figure 1:
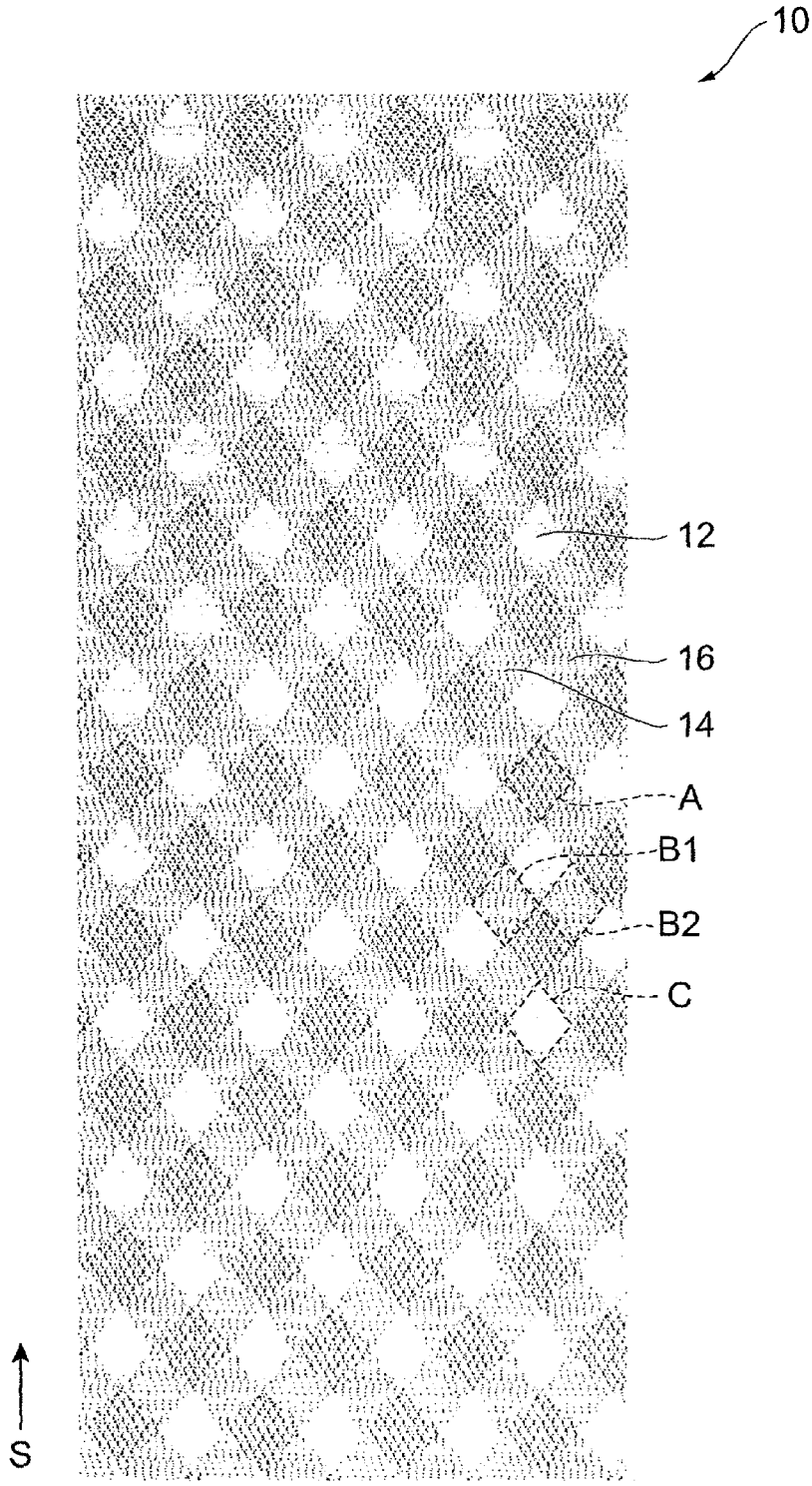
FIG. 1 is a plan view showing a warp knitted fabric according to an embodiment of the present invention.

The warp knitted fabric 10, as shown in FIG. 1, has a ground structure 12 and insert yarn groups 14, 16. An arrow S in each drawing indicates a knitting direction of the warp knitted fabric 10. It is, however, also possible to make up the warp knitted fabric 10 by feeding yarns in a direction opposite to the direction indicated by arrow S.

Figure 2:
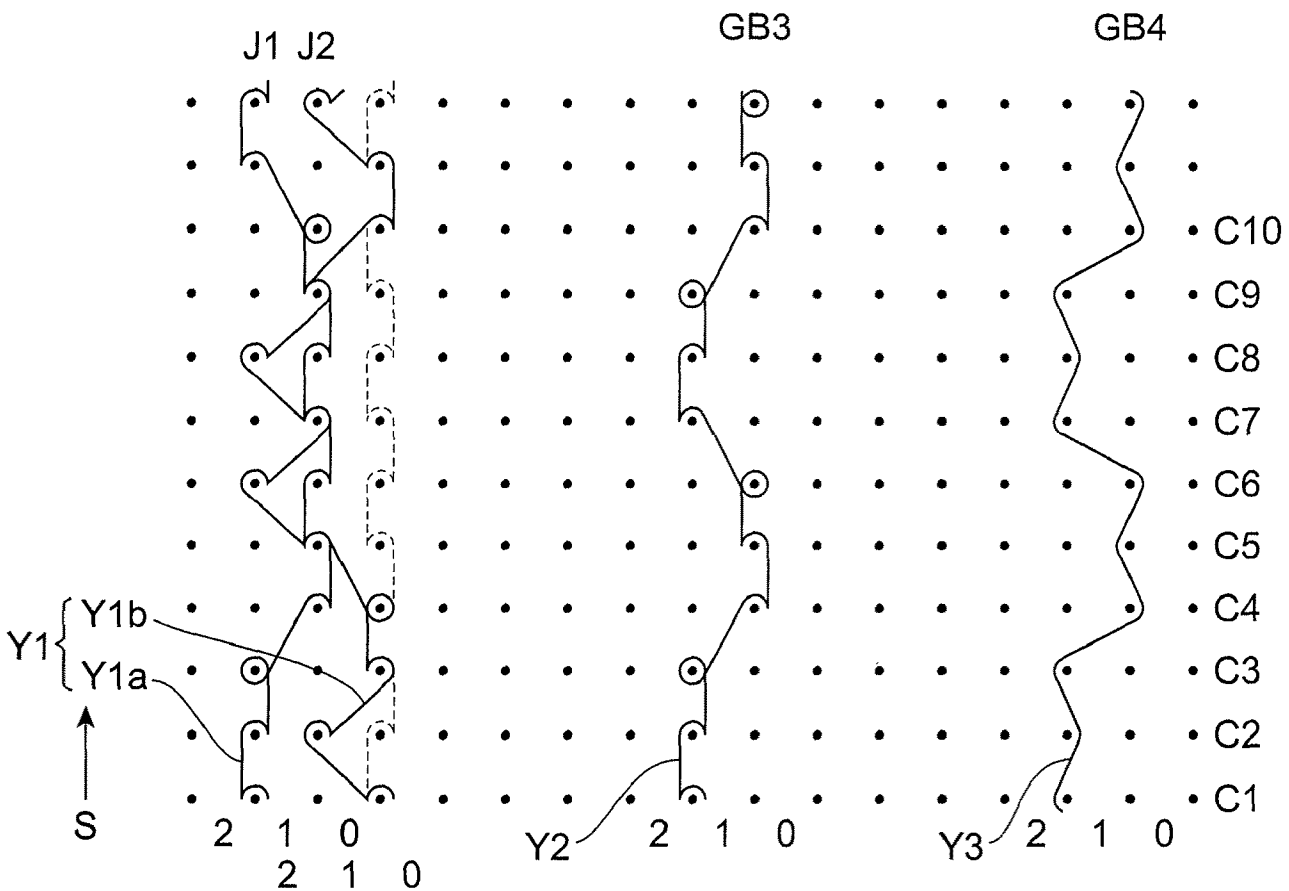
FIG. 2 is a texture diagram of a ground structure.

The ground structure 12 is a basis of the warp knitted fabric 10 and is present throughout the entire warp knitted fabric 10. The ground structure 12, as shown in FIG. 2, is composed of three types of yarns Y1-Y3 (ground yarns) in the present embodiment. The yarns Y1, Y2 applicable herein are, for example, nylon yarns of 33 decitex and 26 filaments (Ny33T/26-2M94 available from Toray Industries, Inc.). The yarn Y3 applicable herein is, for example, a polyurethane yarn of 310 decitex (Roica (registered trademark) 310T-C804 available from Asahi Kasei Fibers Corp.).

Figure 3:
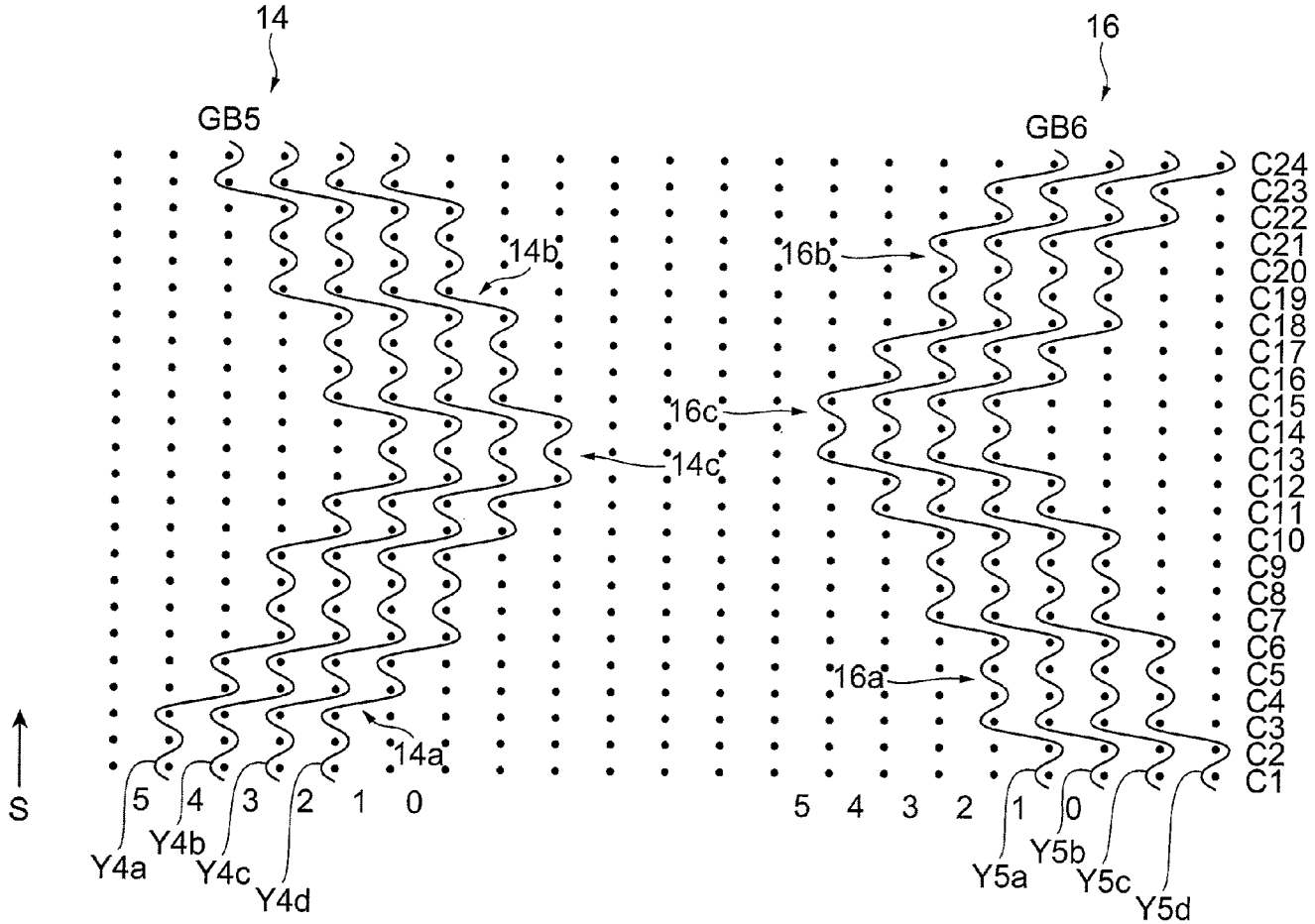
FIG. 3 is a texture diagram of yarns Y4*a*-Y4*d* and yarns Y5*a*-Y5*d*.
Figure 4:
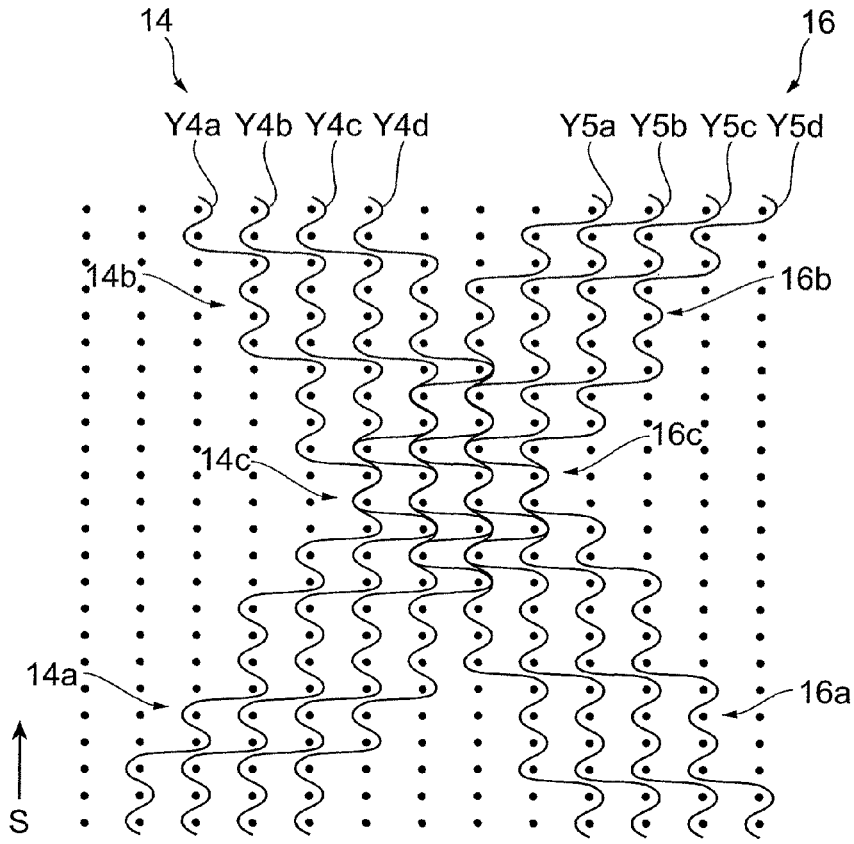
FIG. 4 is a drawing partly showing a state in which yarns Y4*a*-Y4*d* and yarns Y5*a*-Y5*d* are inserted in a ground structure.

In the texture diagrams of FIGS. 2 to 4, black dots represent positions of needle heads in respective courses and weft-directional gaps between black dots represent needle spaces. Furthermore, in the texture diagrams of FIGS. 2 to 4, each line of black dots aligned in the weft direction represents a course and each single yarn indicates how the yarn is knitted in each course with supply of the yarn in the direction of arrow S. Yet furthermore, in the texture diagrams of FIGS. 2 to 4, for the purpose of indicating knitting of yarns by positions of needle spaces, the rightmost needle space where each yarn passes while being guided by a guide bar is denoted by 0 and numbers 1, 2, 3, . . . are given in order therefrom to the left (some types of knitting machines are numbered as 0, 2, 4, 6, . . . ).

The yarn Y1 has a yarn Y1*a* passed through the guide bar of jacquard reed J1 and a yarn Y1*b* passed through the guide bar of jacquard reed J2. The yarns Y1*a*, Y1*b* are fed in the direction of arrow S to be warp-knitted. The jacquard reeds J1, J2 are configured so that each guide bar can be displaced by a length of one needle in the weft direction by a piezoelectric device (piezo element) or the like, in addition to reed motion. The jacquard reeds J1, J2 permit the yarns Y1*a*, Y1*b* to be knitted as different structures. The yarns Y1*a*, Y1*b*, as shown in FIG. 2, are adjacent to each other with a space of one wale between them. A dashed line shown in FIG. 2 indicates a texture diagram of the yarn Y1 without the weft-directional displacement by the piezoelectric device (piezo element) or the like of the jacquard reeds J1, J2.

Specifically, the yarn Y1*a* moves from the No. 1 needle space to the No. 2 needle space in the course C1, moves from the No. 2 needle space to the No. 1 needle space in the course C2, moves from the No. 1 needle space to the No. 2 needle space in the course C3, moves from the No. 1 needle space to the No. 0 needle space in the course C4, moves from the No. 0 needle space to the No. 1 needle space in the course C5, moves from the No. 2 needle space to the No. 1 needle space in the course C6, moves from the No. 0 needle space to the No. 1 needle space in the course C7, moves from the No. 2 needle space to the No. 1 needle space in the course C8, moves from the No. 0 needle space to the No. 1 needle space in the course C9, moves from the No. 1 needle space to the No. 0 needle space in the course C10, and repeats the above movement thereafter. Namely, the yarn Y1*a* has one repeating unit of 10 courses. This knitting of the yarn Y1*a* can be represented by "12/21/12/10/01/21/01/21/01/10//." By this knitting, the yarn Y1*a* constitutes a looping structure comprising a mixture of open loops (in a state in which each loop is open without a cross) and closed loops (in a state in which each loop has a cross to form a closed stitch).

The yarn Y1*b* moves from the No. 0 needle space to the No. 1 needle space in the course C1, moves from the No. 2 needle space to the No. 1 needle space in the course C2, moves from the No. 0 needle space to the No. 1 needle space in the course C3, moves from the No. 1 needle space to the No. 0 needle space in the course C4, moves from the No. 1 needle space to the No. 2 needle space in the course C5, moves from the No. 2 needle space to the No. 1 needle space in the course C6, moves from the No. 1 needle space to the No. 2 needle space in the course C7, moves from the No. 2 needle space to the No. 1 needle space in the course C8, moves from the No. 1 needle space to the No. 2 needle space in the course C9, moves from the No. 1 needle space to the No. 0 needle space in the course C10, and repeats the above movement thereafter. Namely, the yarn Y1*b* has one repeating unit of 10 courses. This knitting of the yarn Y1*b* can be represented by "01/21/01/10/12/21/12/21/12/10//." By this knitting, the yarn Y1*b* constitutes a looping structure comprising a mixture of open loops and closed loops. In the actual ground structure 12, the yarns Y1*a* and Y1*b* are alternately arranged side by side one wale apart from each other in the weft direction and the weftwise adjacent yarns Y1*a*, Y1*b* are intertwined with each other.

The yarn Y2 is passed through the guide bar of reed GB3 and fed in the direction of arrow S to be warp-knitted. Specifically, the yarn Y2 moves from the No. 1 needle space to the No. 2 needle space in the course C1, moves from the No. 2 needle space to the No. 1 needle space in the course C2, moves from the No. 1 needle space to the No. 2 needle space in the course C3, moves from the No. 1 needle space to the No. 0 needle space in the course C4, moves from the No. 0 needle space to the No. 1 needle space in the course C5, moves from the No. 1 needle space to the No. 0 needle space in the course C6, and repeats the above movement thereafter. Namely, the yarn Y2 has one repeating unit of 6 courses. This knitting of the yarn Y2 can be represented by "12/21/12/10/01/10//." By this knitting, the yarn Y2 constitutes a looping structure comprising a mixture of open and closed loops. In the actual ground structure 12, a plurality of yarns Y2 are weftwise arranged side by side one wale apart from each other and the weftwise adjacent yarns Y2 are intertwined with each other.

The yarn Y3 is passed through the guide bar of reed GB4 and fed in the direction of arrow S to be inserted along the warp direction in a knit structure warp-knitted of the yarns Y1, Y2. Specifically, the yarn Y3 swings in at the position of the No. 2 needle space and swings out at the same position in the course C1, swings in at the position of the No. 1 needle space and swings out at the same position in the course C2, swings in at the position of the No. 2 needle space and swings out at the same position in the course C3, swings in at the position of the No. 0 needle space and swings out at the same position in the course C4, swings in at the position of the No. 1 needle space and swings out at the same position in the course C5, swings in at the position of the No. 0 needle space and swings out at the same position in the course C6, and repeats the above swing motion thereafter. Namely, the yarn Y3 has one repeating unit of 6 courses. This knitting of the yarn Y3 can be represented by "22/11/22/00/11/0011." This knitting brings the yarn Y3 into a state in which it lies between needle loops, between sinker loops, or the like, i.e., a state in which it is knitted with the yarns Y1, Y2 and the intertwined yarns Y1, Y2, to constitute an insertion structure. In the actual ground structure 12, a plurality of yarns Y3 are arranged side by side one wale apart from each other in the weft direction.

The insert yarn group 14 (primary insert yarn group), as shown in FIG. 3, is composed of four yarns Y4*a*-Y4*d* (first to fourth primary insert yarns) of the same kind. The yarns Y4*a*-Y4*d* applicable herein are, for example, polyurethane yarns of 78 decitex (Roica (registered trademark) 78T-C805 available from Asahi Kasei Fibers Corp.).

The yarns Y4*a*-Y4*d* are passed through respective guide bars of reed GB5 and fed in the direction of arrow S to be inserted along the warp direction in the knit structure warp-knitted of the yarns Y1, Y2, in a state in which they are arranged side by side one wale apart from each other in the weft direction. Specifically, the yarn Y4*a* swings in and out at the position of the No. 5 needle space in the course C1, swings in and out at the position of the No. 4 needle space in the course C2, swings in and out at the position of the No. 5 needle space in the course C3, swings in and out at the position of the No. 3 needle space in the course C4, swings in and out at the position of the No. 4 needle space in the course C5, swings in and out at the position of the No. 2 needle space in the course C6, swings in and out at the position of the No. 3 needle space in the course C7, swings in and out at the position of the No. 2 needle space in the course C8, swings in and out at the position of the No. 3 needle space in the course C9, swings in and out at the position of the No. 1 needle space in the course C10, swings in and out at the position of the No. 2 needle space in the course C11, swings in and out at the position of the No. 0 needle space in the course C12, swings in and out at the position of the No. 1 needle space in the course C13, swings in and out at the position of the No. 0 needle space in the course C14, swings in and out at the position of the No. 2 needle space in the course C15, swings in and out at the position of the No. 1 needle space in the course C16, swings in and out at the position of the No. 2 needle space in the course C17, swings in and out at the position of the No. 1 needle space in the course C18, swings in and out at the position of the No. 3 needle space in the course C19, swings in and out at the position of the No. 2 needle space in the course C20, swings in and out at the position of the No. 3 needle space in the course C21, swings in and out at the position of the No. 2 needle space in the course C22, swings in and out at the position of the No. 4 needle space in the course C23, swings in and out at the position of the No. 3 needle space in the course C24, and repeats the above swing motion thereafter. Namely, the yarn Y4*a* has one repeating unit of 24 courses.

This knitting of the yarn Y4*a* can be represented by "55/44/55/33/44/22/33/22/33/11/22/00/11/00/22/11/22/11/33/22/33/22/44/33//." This knitting brings the yarn Y4*a* into a state in which it lies between needle loops, between sinker loops, or the like, i.e., a state in which it is knitted with the yarns Y1, Y2 and the intertwined yarns Y1, Y2, thereby constituting an insertion structure.

The yarn Y4*a*, as shown in FIG. 3, as a whole has a meandering shape. Specifically, the yarn Y4*a* runs as a whole in the warp direction with proceed from the course C1 to the course C3, runs as a whole rightward in the drawing with proceed from the course C3 to the course C12, runs as a whole in the warp direction with proceed from the course C12 to the course C14, and runs as a whole leftward in the drawing with proceed from the course C14 to the course C24. For this reason, a portion 14*a* (first portion) in the courses C3 to C12 of the yarn Y4*a* extends as a whole in a direction crossing the warp direction, a portion 14*b* (second portion) in the courses C14-C24 of the yarn Y4*a* extends as a whole in a direction crossing the warp direction, and a portion 14*c* (curved portion) in the courses C12-C14 of the yarn Y4*a* is a curved portion extending as a whole in a direction along the warp direction and connecting the portions 14*a*, 14*b*. The same also applies to the yarns Y4*b*-Y4*d*.

The insert yarn group 16 (secondary insert yarn group), as shown in FIG. 3, is composed of four yarns Y5*a*-Y5*d* (first to fourth secondary insert yarns) of the same kind. The yarns Y5*a*-Y5*d* applicable herein are, for example, polyurethane yarns of 78 decitex (Roica (registered trademark) 78T-C805 available from Asahi Kasei Fibers Corp.).

The yarns Y5*a*-Y5*d* are passed through respective guide bars of reed GB6 and fed in the direction of arrow S to be inserted along the warp direction in the knit structure warp-knitted of the yarns Y1, Y2, in a state in which they are arranged side by side one wale apart from each other in the weft direction. Specifically, the yarn Y5*a* swings in and out at the position of the No. 1 needle space in the course C1, swings in and out at the position of the No. 0 needle space in the course C2, swings in and out at the position of the No. 2 needle space in the course C3, swings in and out at the position of the No. 1 needle space in the course C4, swings in and out at the position of the No. 2 needle space in the course C5, swings in and out at the position of the No. 1 needle space in the course C6, swings in and out at the position of the No. 3 needle space in the course C7, swings in and out at the position of the No. 2 needle space in the course C8, swings in and out at the position of the No. 3 needle space in the course C9, swings in and out at the position of the No. 2 needle space in the course C10, swings in and out at the position of the No. 4 needle space in the course C11, swings in and out at the position of the No. 3 needle space in the course C12, swings in and out at the position of the No. 5 needle space in the course C13, swings in and out at the position of the No. 4 needle space in the course C14, swings in and out at the position of the No. 5 needle space in the course C15, swings in and out at the position of the No. 3 needle space in the course C16, swings in and out at the position of the No. 4 needle space in the course C17, swings in and out at the position of the No. 2 needle space in the course C18, swings in and out at the position of the No. 3 needle space in the course C19, swings in and out at the position of the No. 2 needle space in the course C20, swings in and out at the position of the No. 3 needle space in the course C21, swings in and out at the position of the No. 1 needle space in the course C22, swings in and out at the position of the No. 2 needle space in the course C23, swings in and out at the position of the No. 0 needle space in the course C24, and repeats the above swing motion thereafter. Namely, the yarn Y5*a* has one repeating unit of 24 courses.

This knitting of the yarn Y5*a* can be represented by "11/00/22/11/22/11/33/22/33/22/44/33/55/44/55/33/44/22/33/22/33/11/22/00//." This knitting brings the yarn Y5*a* into a state in which it lies between needle loops, between sinker loops, or the like, i.e., a state in which it is knitted with the yarns Y1, Y2 and the intertwined yarns Y1, Y2, thereby constituting an insertion structure.

The yarn Y5*a*, as shown in FIG. 3, as a whole has a meandering shape. Specifically, the yarn Y5*a* runs as a whole in the warp direction with proceed from the course C1 to the course C2, runs as a whole leftward in the drawing with proceed from the course C2 to the course C13, runs as a whole in the warp direction with proceed from the course C13 to the course C15, and runs as a whole rightward in the drawing with proceed from the course C15 to the course C24. For this reason, a portion 16*a* (first portion) in the courses C2-C13 of the yarn Y5*a* extends as a whole in a direction crossing the warp direction, a portion 16*b* (second portion) in the courses C15-C24 of the yarn Y5*a* extends as a whole in a direction crossing the warp direction, and a portion 16*c* (curved portion) in the courses C13-C15 of the yarn Y5*a* is a curved portion extending as a whole in a direction along the warp direction and connecting the portions 16*a*, 16*b*. The same also applies to the yarns Y5*b*-Y5*d*.

The state in which the yarns Y4*a*-Y4*d* and the yarns Y5*a*-Y5*d* are inserted in the ground structure 12 will be described below with reference to FIG. 4. First, with focus on the yarn Y4*a* and the yarn Y5*a*, the portion 14*a* of the yarn Y4*a* and the portion 16*a* of the yarn Y5*a* are knitted in the ground structure 12 while becoming closer to each other, with proceed in the warp direction (the direction of arrow S). The portion 14*b* of the yarn Y4*a* and the portion 16*b* of the yarn Y5*a* are knitted in the ground structure 12 while becoming farther away from each other, with proceed in the warp direction (the direction of arrow S). The portion 14*c* of the yarn Y4*a* and the portion 16*c* of the yarn Y5*a* overlap each other when viewed from the thickness direction. For this reason, it can be said that the yarn Y4*a* and the yarn Y5*a* are in a correspondence relation, in terms of the overlap between the portion 14*c* of the yarn Y4*a* and the portion 16*c* of the yarn Y5*a*. The term "overlap each other when viewed from the thickness direction" herein shall generally embrace, not only the case where they are perfectly superimposed to coincide, but also the case where the needle spaces passed by the portion 14*c* of the yarn Y4*a* coincide with those passed by the portion 16*c* of the yarn Y5*a*.

Next, with focus on the yarn Y4*b* and the yarn Y5*b*, the portion 14*a* of the yarn Y4*b* and the portion 16*a* of the yarn Y5*b* are knitted in the ground structure 12 while becoming closer to each other, with proceed in the warp direction (the direction of arrow S). The portion 14*b* of the yarn Y4*b* and the portion 16*b* of the yarn Y5*b* are knitted in the ground structure 12 while becoming farther away from each other, with proceed in the warp direction (the direction of arrow S). The portion 14*c* of the yarn Y4*b* and the portion 16*c* of the yarn Y5*b* overlap each other when viewed from the thickness direction. For this reason, it can be said that the yarn Y4*b* and the yarn Y5*b* are in a correspondence relation, in terms of the overlap between the portion 14*c* of the yarn Y4*b* and the portion 16*c* of the yarn Y5*b*. The term "overlap each other when viewed from the thickness direction" herein shall generally embrace, not only the case where they are perfectly superimposed to coincide, but also the case where the needle spaces passed by the portion 14*c* of the yarn Y4*b* coincide with those passed by the portion 16*c* of the yarn Y5*b*.

Next, with focus on the yarn Y4*c* and the yarn Y5*c*, the portion 14*a* of the yarn Y4*c* and the portion 16*a* of the yarn Y5*c* are knitted in the ground structure 12 while becoming closer to each other, with proceed in the warp direction (the direction of arrow S). The portion 14*b* of the yarn Y4*c* and the portion 16*b* of the yarn Y5*c* are knitted in the ground structure 12 while becoming farther away from each other, with proceed in the warp direction (the direction of arrow S). The portion 14*c* of the yarn Y4*c* and the portion 16*c* of the yarn Y5*c* overlap each other when viewed from the thickness direction. For this reason, it can be said that the yarn Y4*c* and the yarn Y5*c* are in a correspondence relation, in terms of the overlap between the portion 14*c* of the yarn Y4*c* and the portion 16*c* of the yarn Y5*c*. The term "overlap each other when viewed from the thickness direction" herein shall generally embrace, not only the case where they are perfectly superimposed to coincide, but also the case where the needle spaces passed by the portion 14*c* of the yarn Y4*c* coincide with those passed by the portion 16*c* of the yarn Y5*c*.

Next, with focus on the yarn Y4*d* and the yarn Y5*d*, the portion 14*a* of the yarn Y4*d* and the portion 16*a* of the yarn Y5*d* are knitted in the ground structure 12 while becoming closer to each other, with proceed in the warp direction (the direction of arrow S). The portion 14*b* of the yarn Y4*d* and the portion 16*b* of the yarn Y5*d* are knitted in the ground structure 12 while becoming farther away from each other, with proceed in the warp direction (the direction of arrow S). The portion 14*c* of the yarn Y4*d* and the portion 16*c* of the yarn Y5*d* overlap each other when viewed from the thickness direction. For this reason, it can be said that the yarn Y4*d* and the yarn Y5*d* are in a correspondence relation, in terms of the overlap between the portion 14*c* of the yarn Y4*d* and the portion 16*c* of the yarn Y5*d*. The term "overlap each other when viewed from the thickness direction" herein shall generally embrace, not only the case where they are perfectly superimposed to coincide, but also the case where the needle spaces passed by the portion 14*c* of the yarn Y4*d* coincide with those passed by the portion 16*c* of the yarn Y5*d*.

From the above, the warp knitted fabric 10, as shown in FIG. 1, comes to have regions A comprising the ground structure 12, regions B1 comprising the ground structure 12 and the insert yarn group 14, regions B2 comprising the ground structure 12 and the insert yarn group 16, and regions C comprising the ground structure 12 and the insert yarn groups 14, 16.

In the present embodiment as described above, the yarns Y4*a*-Y4*d*, Y5*a*-Y5*d* are inserted along the warp direction in the ground structure 12, the yarns Y4*a*-Y4*d* are formed as a whole in the meandering shape of the portions 14*a*-14*c*, and the yarns Y5*a*-Y5*d* are formed as a whole in the meandering shape of the portions 16*a*-16*c*. For this reason, the strength of the warp knitted fabric is ensured in the lengthwise direction. In the present embodiment, the yarns Y4*a*-Y4*d*, Y5*a*-Y5*d* each are inserted and knitted in the ground structure 12 so that the portion 14*c* of the yarn Y4*a* and the portion 16*c* of the yarn Y5*a* overlap each other when viewed from the thickness direction, so that the portion 14*c* of the yarn Y4*b* and the portion 16*c* of the yarn Y5*b* overlap each other when viewed from the thickness direction, so that the portion 14*c* of the yarn Y4*c* and the portion 16*c* of the yarn Y5*c* overlap each other when viewed from the thickness direction, and so that the portion 14*c* of the yarn Y4*d* and the portion 16*c* of the yarn Y5*d* overlap each other when viewed from the thickness direction. For this reason, the yarn Y4*a* and the yarn Y5*a* are connected through the ground structure 12 by the portion 14*c* and the portion 16*c*, the portion 14*a* of the yarn Y4*a* and the portion 16*b* of the yarn Y5*a* form a line extending as if it is continuous in a bias direction (direction crossing the warp direction and weft direction), and the portion 14*b* of the yarn Y4*a* and the portion 16*a* of the yarn Y5*a* form a line extending as if it is continuous in a bias direction. The same also applies to the yarns Y4*b*-Y4*d*, Y5*b*-Y5*d*. Therefore, the strength is ensured in the bias and weft directions. As a result, the fabric is able to exhibit isotropy of strength.

The above detailed the preferred embodiment of the present invention, but it should be noted that the present invention is not limited only to the above embodiment. For example, the yarns Y1, Y2 used in the present embodiment were the nylon yarns of inelastic yarns, but it is also possible to use polyester yarns as other inelastic yarns. The yarns Y3-Y5 used were the polyurethane yarns (spandex yarns) of elastic yarns, but it is also possible to use other stretchable yarns such as SCY (single covering yarn) and DCY (double covering yarn) as other elastic yarns, or to use covering elastic yarns in which the outside of elastic yarns is covered by other synthetic fiber.

The thickness of the yarns Y1, Y2 is preferably in the range of 22 decitex to 78 decitex and more preferably in the range of 28 decitex to 44 decitex. The thickness of the yarn Y3 is preferably in the range of 44 decitex to 620 decitex and more preferably in the range of 78 decitex to 470 decitex. The thickness of the yarns Y4, Y5 is preferably in the range of 22 decitex to 620 decitex and more preferably in the range of 44 decitex to 390 decitex.

In the present embodiment the looping structures of the ground structure 12 were formed of the yarns Y1, Y2 and the insertion structure of the ground structure 12 was formed of the yarn Y3, but it is also possible to form the ground structure 12 in which all the yarns Y1, Y2, and Y3 constitute looping structures.

In the present embodiment, the insert yarn group 14 was composed of the four yarns Y4*a*-Y4*d* and the insert yarn group 16 was composed of the four yarns Y5*a*-Y5*d*; however, the number of yarns constituting the insert yarn group 14 or 16 may be two or more.

In the present embodiment the yarns Y4*a*-Y4*d*, Y5*a*-Y5*d* had one repeating unit of 24 courses, but the repeating unit is not limited to 24 courses as long as the yarns Y4*a*-Y4*d*, Y5*a*-Y5*d* as a whole have the meandering shape and have the mutually overlapping portions and mutually non-overlapping portions when viewed from the thickness direction. However, as the number of courses in the repeating unit decreases, the weft-directional swing width as a whole of the yarns Y4*a*-Y4*d*, Y5*a*-Y5*d* becomes smaller and the area of region A comprising the ground structure 12 becomes smaller; therefore, the strength tends to increase. On the other hand, as the number of courses in the repeating unit increases, the weft-directional swing width as a whole of the yarns Y4*a*-Y4*d*, Y5*a*-Y5*d* becomes larger and the area of region A comprising the ground structure 12 becomes larger; therefore, the strength tends to decrease.

Figure 5:
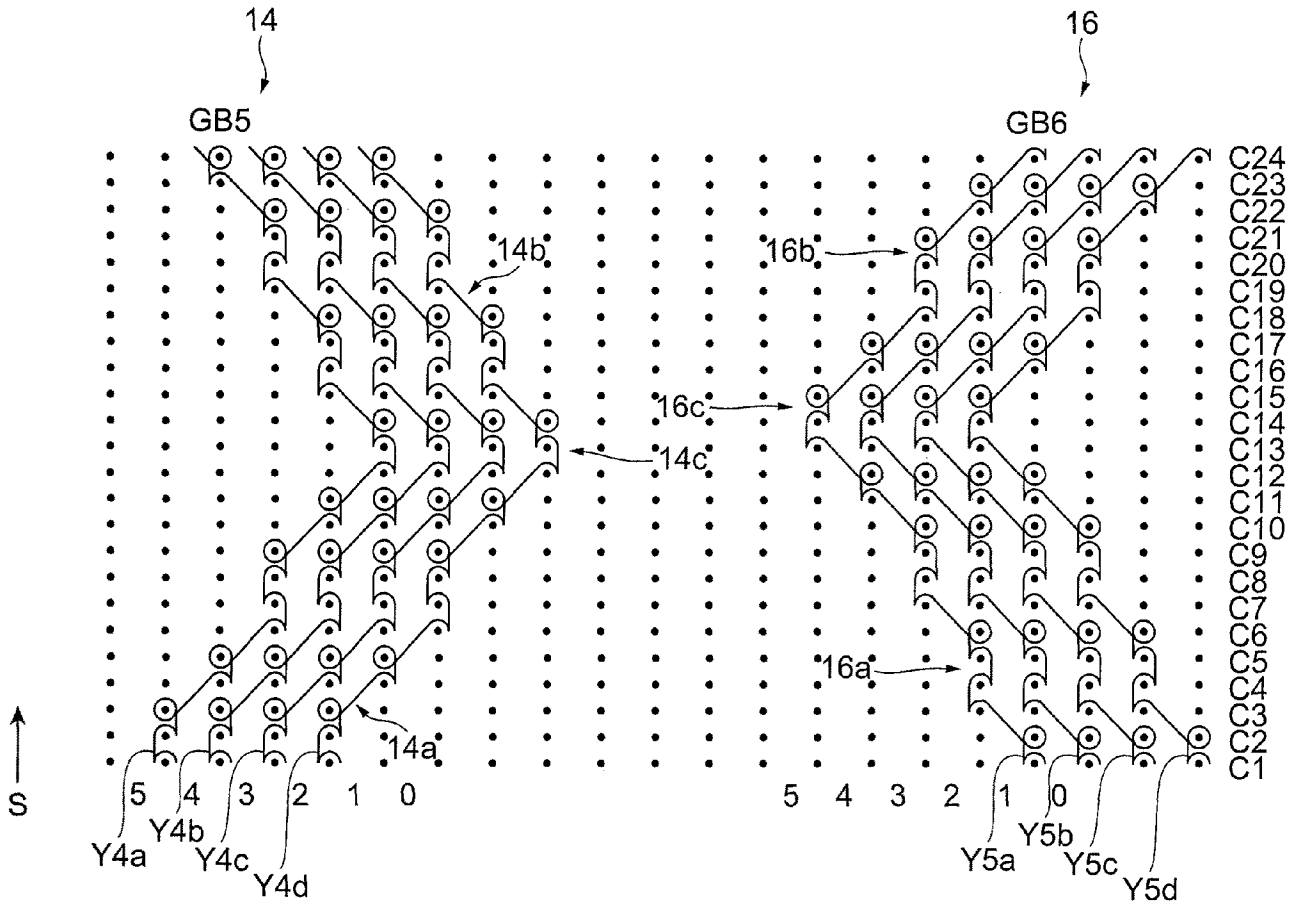
FIG. 5 is a texture diagram of yarns Y4*a*-Y4*d* and yarns Y5*a*-Y5*d* in a warp knitted fabric as another example according to the embodiment.

In the present embodiment the insertion structure was composed of the yarns Y4*a*-Y4*d*, Y5*a*-Y5*d* as a whole having the meandering shape, but it is also possible to form a looping structure of the yarns Y4*a*-Y4*d*, Y5*a*-Y5*d* as a whole having the meandering shape. Specifically, for example as shown in FIG. 5, the yarns Y4*a*-Y4*d* are knitted as represented by "45/54/45/43/34/32/23/32/23/21/12/10/01/10/12/21/12/21/23/32/23/32/3 4/43/4" and the yarns Y5*a*-Y5*d* are knitted as represented by "01/10/12/21/12/21/23/32/23/32/34/43/45/54/45/43/34/32/23/32/23/21/1 2/10//." FIG. 6 partly shows a state in which these yarns Y4*a*-Y4*d*, Y5*a*-Y5*d* are knitted with the ground structure 12. In this case, weftwise adjacent yarns are intertwined with each other among the yarns Y4*a*-Y4*d*, Y5*a*-Y5*d*.

Figure 6:
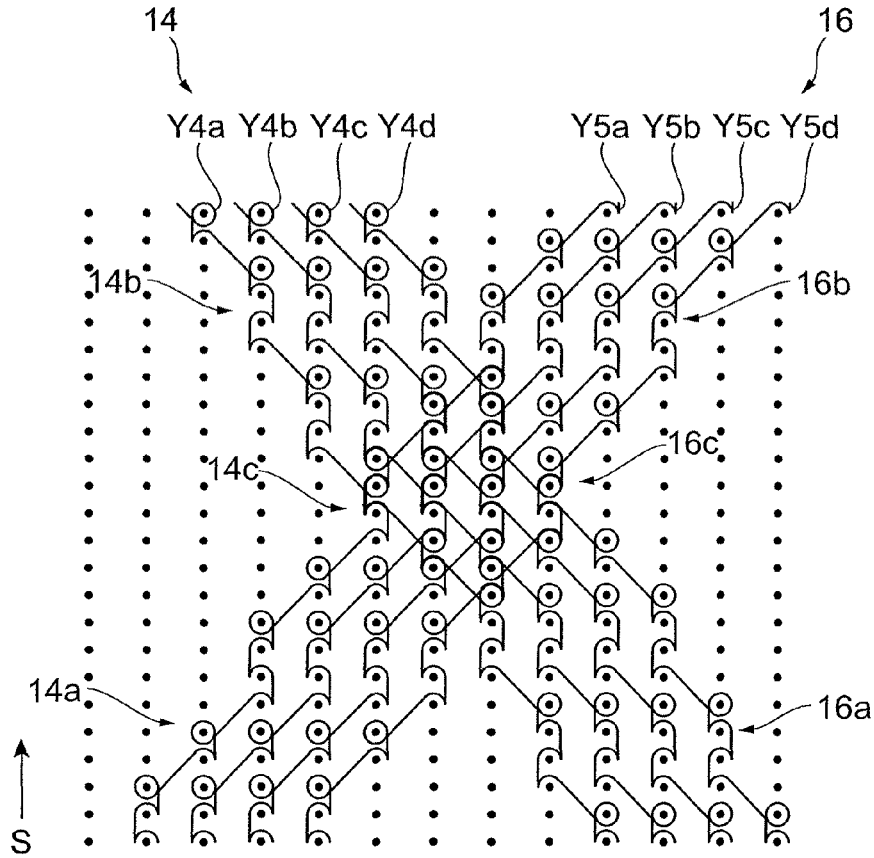
FIG. 6 is a drawing partly showing a state in which yarns Y4*a*-Y4*d* and yarns Y5*a*-Y5*d* are knitted with a ground structure in the warp knitted fabric as the other example according to the embodiment.
Figure 10:
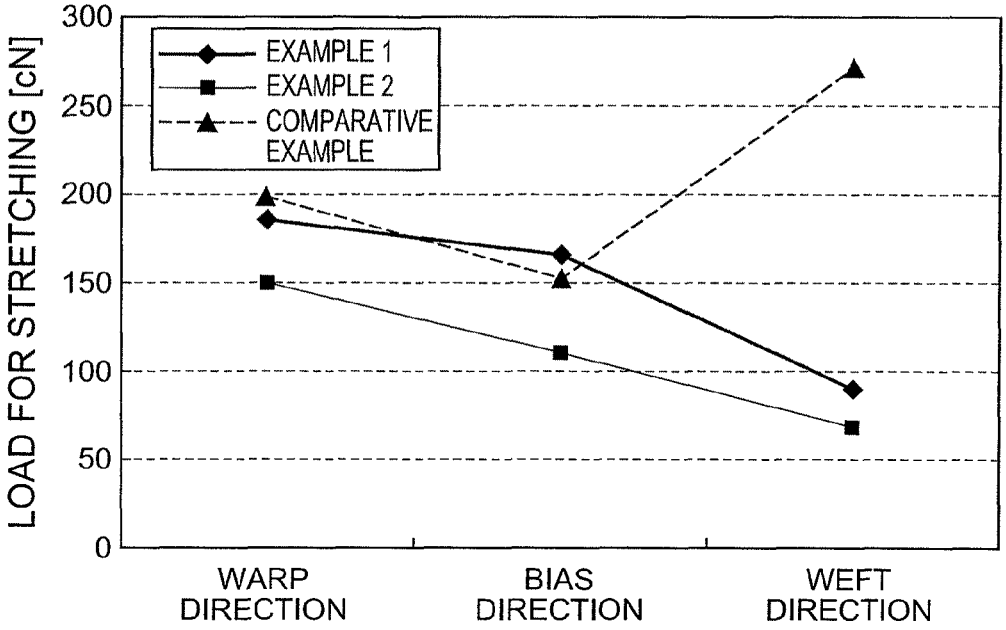
FIG. 10 is a drawing showing the respective test results of Examples 1, 2 and Comparative Example with the warp direction, bias direction, and weft direction on the horizontal axis and with the load for stretching in the first stretch on the vertical axis.
Figure 11:
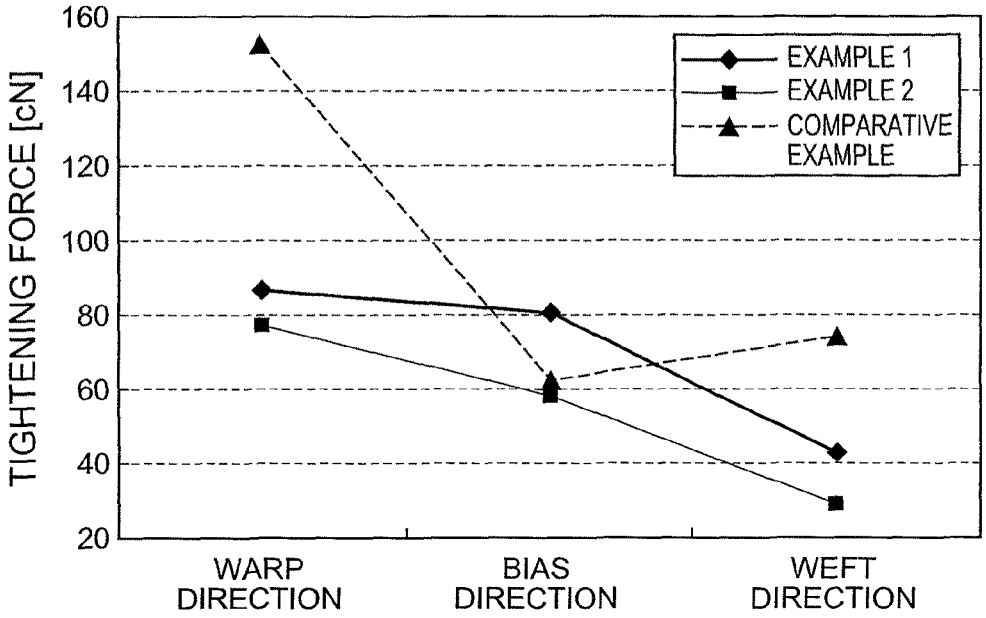
FIG. 11 is a drawing showing the respective test results of Examples 1, 2 and Comparative Example with the warp direction, bias direction, and weft direction on the horizontal axis and with the tightening force in the first stretch on the vertical axis.
Figure 12:
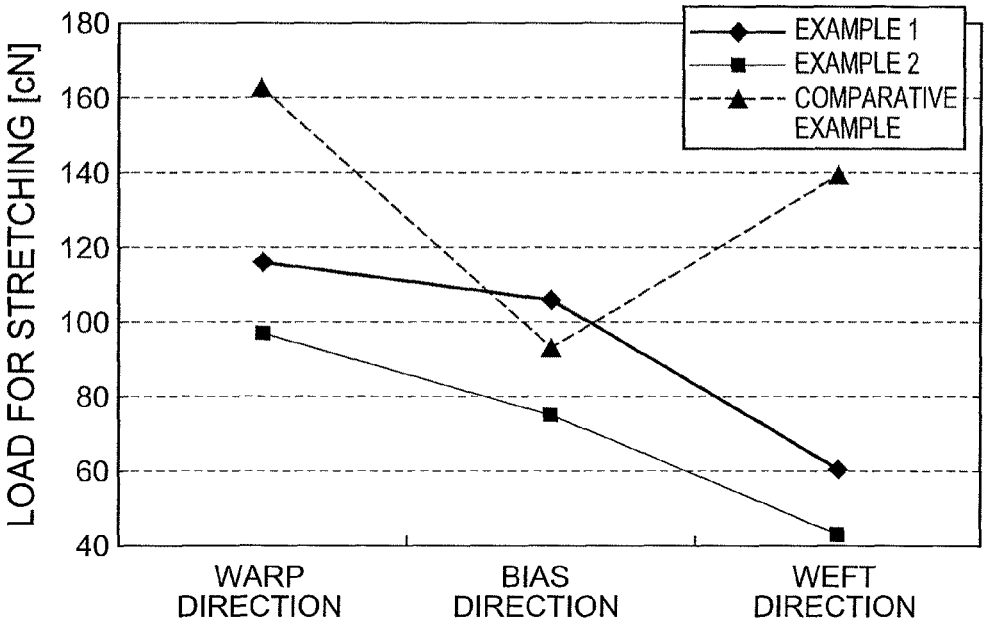
FIG. 12 is a drawing showing the respective test results of Examples 1, 2 and Comparative Example with the warp direction, bias direction, and weft direction on the horizontal axis and with the load for stretching in the third stretch on the vertical axis.
Figure 13:
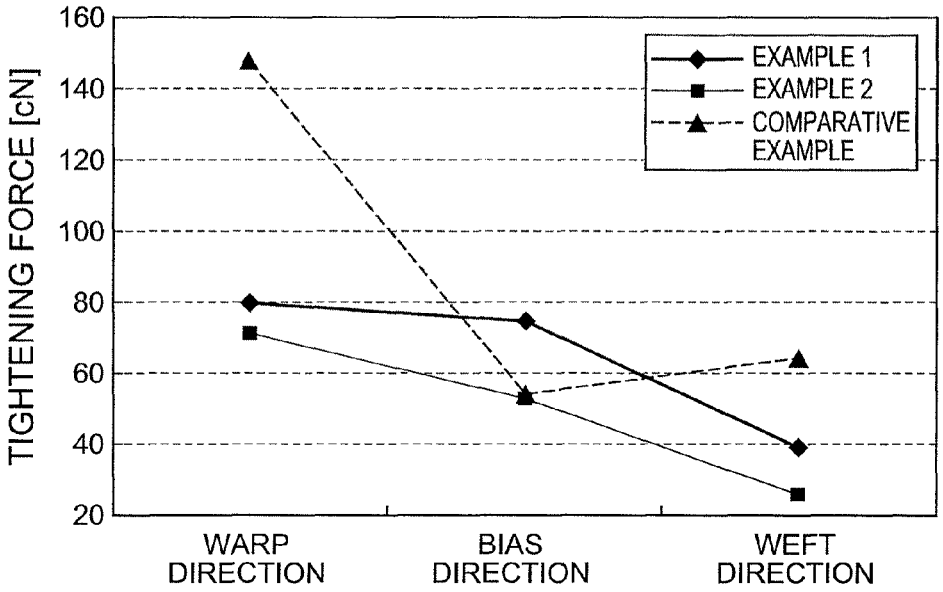
FIG. 13 is a drawing showing the respective test results of Examples 1, 2 and Comparative Example with the warp direction, bias direction, and weft direction on the horizontal axis and with the tightening force in the third stretch on the vertical axis.

FIGS. 3 and 4 show the configuration wherein all the yarns Y4*a*-Y4*d*, Y5*a*-Y5*d* constitute the insertion structure in the knitting direction of the warp knitted fabric 10 (the direction of arrow S) and FIGS. 5 and 6 show the configuration wherein all the yarns Y4*a*-Y4*d*, Y5*a*-Y5*d* constitute the looping structure in the knitting direction of the warp knitted fabric 10 (the direction of arrow S); however, it is also possible to switch the looping structure and the insertion structure in the knitting direction of the warp knitted fabric 10 (the direction of arrow S). Specifically, it is possible, for example, to knit the yarns Y4*a*-Y4*d*, Y5*a*-Y5*d* in the insertion structure of courses C1-C8, the looping structure of courses C9-C16, and the insertion structure of courses C17-C24.

Patterns may or may not be optionally provided in the warp knitted fabric 10.

EXAMPLES

The present invention will be explained in more detail on the basis of Examples 1, 2 and Comparative Example 1 and FIGS. 7 to 15, but it should be noted that the present invention is by no means intended to be limited to the examples below.

Example 1

The warp knitted fabric 10 prepared was one comprising the ground structure 12 and the insert yarn groups 14, 16, as shown in FIG. 1. In the warp knitted fabric 10 of Example 1, the yarns Y1*a*, Y1*b*, and Y2 used were Ny33T/26-2M94 available from Toray Industries, Inc., the yarn Y3 Mo-78T-R available from Nisshinbo Industries, Inc., and the yarns Y4 and Y5 Roica (registered trademark) 155T-HS available from Asahi Kasei Fibers Corp. The knitting of the yarn Y1*a* passed through the guide bar of jacquard reed J1 and the knitting of the yarn Y1*b* passed through the guide bar of jacquard reed J2 both were "01/10//," the knitting of the yarn Y2 passed through the guide bar of reed GB3 was "12/21/12/10/01/10//," and the knitting of the yarn Y3 passed through the guide bar of reed GB4 was "22/11/22/00/11/00//." The insert yarn group 14 comprised eighteen yarns Y4, and each yarn Y4 was passed through the guide bar of reed GB5 and knitted so that the yarn Y4 as a whole had the meandering shape and one repeating unit of 120 courses. The insert yarn group 16 comprised eighteen years Y5, and each yarn Y5 was passed through the guide bar of reed GB6 and knitted so that the yarn Y5 as a whole had the meandering shape and one repeating unit of 120 courses. Then the warp knitted fabric 10 of Example 1 was cut to obtain a test piece having the width (in the weft direction) of 2.5 cm and the length (in the warp direction) of 20 cm.

Next, in accordance with the cut strip method of JIS L1018 8.15.1 elastic recovery percentage of elongation, method A (constant elongation method), the test piece was subjected to a stretch test under the following conditions: in each of the warp direction, weft direction, and a bias direction (45° diagonally upward and rightward direction with the knit end of front face of the test piece up), the test piece was stretched to the elongation of 80%, then the test piece was immediately returned to the original position at the same speed, and this operation was repeated three times. A tensile force (load for stretching) of the test piece at the elongation of 30% during extension of the test piece and a tensile force (tightening force) of the test piece at the elongation of 30% during contraction of the test piece were measured in each of the first and third stretch operations. The reason why the loads for stretching and the tightening forces were measured at the elongation of 30% was that when a garment (underwear) was made up of the warp knitted fabric 10, the elongation rarely exceeded 30% with a wearer wearing it.

Test machine: tensile testing machine of constant rate of elongation type

Width of test piece: 2.5 cm

Distance between grips: 10 cm

Test speed: 30 cm/min

Initial load: 0 cN

Repeat count: 3

Time for test piece to be left after elongation: 0 sec

Time for test piece to be left after return to original position: 0 sec

Example 2

When compared with the warp knitted fabric 10 of Example 1, the warp knitted fabric 10 was prepared in the same manner as in Example 1, except that the insert yarn group 14 comprised four yarns Y4 and each yarn Y4 was passed through the guide bar of reed GB5 and knitted so that the yarn Y4 as a whole had the meandering shape and one repeating unit of 24 courses and except that the insert yarn group 16 comprised four yarns Y5 and each yarn Y5 was passed through the guide bar of reed GB6 and knitted so that the yarn Y5 as a whole had the meandering shape and one repeating unit of 24 courses. Then the warp knitted fabric 10 of Example 2 was subjected to the same test as in Example 1.

Comparative Example

In the warp knitted fabric of Comparative Example, the yarns Y1*a*, Y1*b*, and Y2 used were Ny33T/26-2M94 available from Toray Industries, Inc., the yarn Y3 used was Roica (registered trademark) 310T-SCR available from Asahi Kasei Fibers Corp., the yarn Y4 used was Roica (registered trademark) 44T-SCR available from Asahi Kasei Fibers Corp., and the yarn Y5 was not used. The knitting of the yarn Y1*a* passed through the guide bar of jacquard reed J1 and the knitting of the yarn Y1*b* passed through the guide bar of jacquard reed J2 both were "21/12/21/01/10/01//," the knitting of the yarn Y2 passed through the guide bar of reed GB3 was "21/23/21/12/10/12//," the knitting of the yarn Y3 passed through the guide bar of reed GB4 "11/33/11/22/00/22/4" and the knitting of the yarn Y4 passed through the guide bar of reed GB5 "11/22/00/11/00/22//." The warp knitted fabric of Comparative Example was also subjected to the same test as in Example 1.

(Test Results)

The test results are shown in FIGS. 7 and 8. FIG. 7 is a table showing the values of the load for stretching and the tightening force in the first stretch operation and FIG. 8 a table showing the values of the load for stretching and the tightening force in the third stretch operation. Standard deviations in Examples 1, 2 and Comparative Example of the loads for stretching and tightening forces in the first and third stretch operations were calculated based on the test results (cf. FIG. 9).

It is seen from FIG. 9 that the standard deviations of Comparative Example are larger than those of Examples 1, 2 as to all of the loads for stretching and tightening forces in the first and third stretch operations. When it is considered that the standard deviation obtained herein represents variation in magnitude of the loads for stretching or variation in magnitude of the tightening forces in the warp direction, bias direction, and weft direction, it is confirmed that the warp knitted fabrics 10 in Examples 1, 2 can be said to have little anisotropy (or to have isotropy) of strength, with little variation in magnitude of loads for stretching or magnitude of tightening forces in the warp direction, bias direction, and weft direction. On the other hand, it is confirmed that the warp knitted fabric of Comparative Example can be said to have significant anisotropy of strength, with great variation in magnitude of loads for stretching or magnitude of tightening forces in the warp direction, bias direction, and weft direction. It is also seen from FIGS. 9 to 13 that the level of the variation of the warp knitted fabric in Comparative Example is greater than the level of the variation of the warp knitted fabric 10 in each of Examples 1, 2.

Based on the test results, a reduction rate between the loads for stretching and a reduction rate between the tightening forces in the first and third stretch operations were calculated for each of the warp direction, bias direction, and weft direction in accordance with Eq (1) below in Examples 1, 2 and Comparative Example (cf. FIGS. 14 and 15). The smaller the reduction rate is, the more resistant to repetitive stretches the warp knitted fabric is; the larger the reduction rate is, the less resistant to repetitive stretches the warp knitted fabric is.

$$\text{Reduction rate [\%]} = (\text{test result in first stretch} - \text{test result in third stretch}) / \text{test result in first stretch} \times 100 \quad (1)$$

Figure 14:
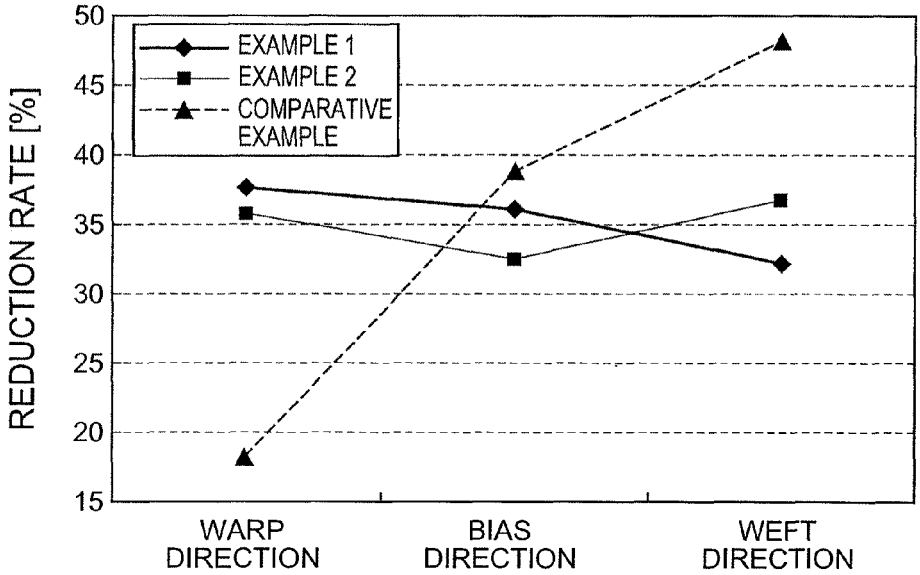
FIG. 14 is a drawing showing respective reduction rates of load for stretching of Examples 1, 2 and Comparative Example with the warp direction, bias direction, and weft direction on the horizontal axis and with the reduction rate on the vertical axis.
Figure 15:
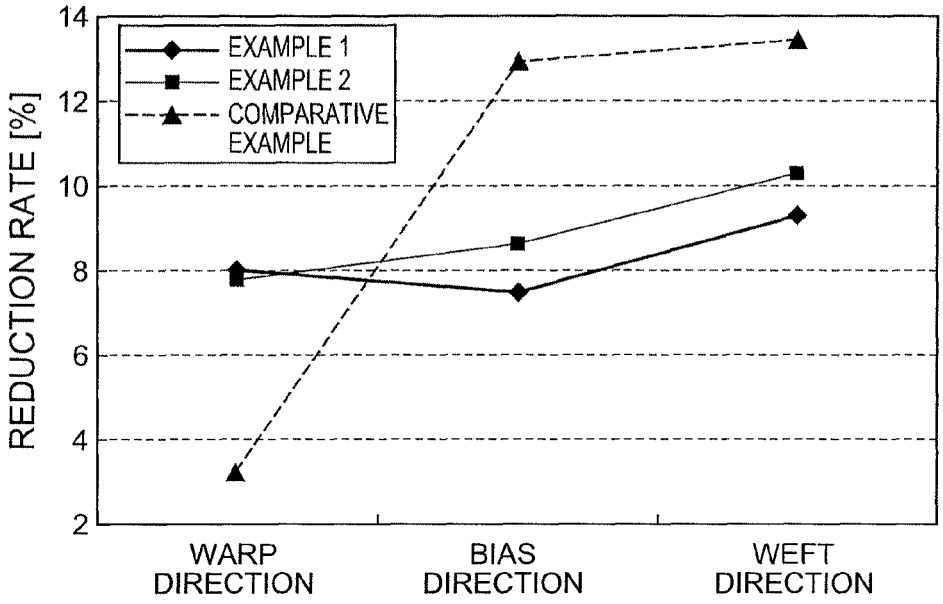
FIG. 15 is a drawing showing respective reduction rates of tightening force of Examples 1, 2 and Comparative Example with the warp direction, bias direction, and well direction on the horizontal axis and with the reduction rate on the vertical axis.

According to FIGS. 14 and 15, the reduction rate is almost constant in all of the warp direction, bias direction, and weft direction in Examples 1, 2, whereas the reduction rate is significantly different depending upon the directions in Comparative Example. Therefore, it is confirmed that the warp knitted fabric 10 in each of Examples 1, 2 stretches almost equally in all the directions in repetitive stretches and maintains the isotropy of strength even after the repetitive stretches. On the other hand, it is confirmed that the warp knitted fabric of Comparative Example becomes easier to stretch in a specific direction in repetitive stretches and shows more significant anisotropy of strength after the repetitive stretches.

REFERENCE SIGNS LIST

10 warp knitted fabric; 12 ground structure; 14 insert yarn group (primary insert yarn group); 14*a* portion (first portion); 14*b* portion (second portion); 14*c* portion (curved portion); 16 insert yarn group (secondary insert yarn group); 16*a* portion (first portion); 16*b* portion (second portion); 16*c* portion (curved portion); Y1-Y3 yarns (ground yarns); Y4*a*-Y4*d* yarns (first to fourth primary insert yarns); Y5*a*-Y5*d* yarns (first to fourth secondary insert yarns); A, B1, B2, and C regions.

The invention claimed is:

1. A warp knitted fabric comprising:

ground yarns constituting a ground structure by warp knitting; and a primary insert yarn group comprising first to Nth, wherein N is a natural number of not less than 2, primary insert yarns and a secondary insert yarn group comprising first to Nth secondary insert yarns, which are inserted along a warp direction in the ground structure to be knitted with the ground structure, thereby constituting an insertion structure, wherein the first to Nth primary insert yarns and the first to Nth secondary insert yarns are arranged side by side in a weft direction, wherein an nth, wherein n is a natural number 1 of to N, primary insert yarn and an nth secondary insert yarn, have respective, first portions knitted in the ground structure while becoming closer to each other in the warp direction, second portions knitted in the ground structure while becoming farther away from each other in the warp direction, and curved portions each of which connects the associated first portion and second portion, wherein the first portion, the second portion, and the curved portion of each insert yarn as a whole form a meandering shape, and wherein the primary insert yarn group and secondary insert yarn group are inserted into the ground structure each time they proceed one course, and at least one insert yarn out of the first to the Nth primary insert yarns is inserted to overlap with at least each of two insert yarns out of the first to the Nth secondary insert yarns when viewed from a thickness direction.

2. A method of manufacturing a warp knitted fabric, comprising:

a step of forming a ground structure by warp knitting of ground yarns and inserting first to Nth, wherein N is a natural number of not less than 2, primary insert yarns to constitute a primary insert yarn group and first to Nth secondary insert yarns to constitute a secondary insert yarn group, each along a warp direction in the ground structure to knit the insert yarns with the ground structure, thereby forming an insertion structure, wherein the first to Nth primary insert yarns and the first to Nth secondary insert yarns are arranged side by side in a weft direction, wherein an nth, wherein n is a natural number of 1 to N, primary insert yarn and an nth secondary insert yarn, have respective, first portions knitted in the ground structure while becoming closer to each other in the warp direction, second portions knitted in the ground structure while becoming farther away from each other in the warp direction, and curved portions each of which connects the associated first portion and second portion, wherein the first portion, the second portion, and the curved portion of each insert yarn as a whole form a meandering shape, and wherein the primary insert yarn group and the secondary insert yarn group are inserted into the ground structure each time they proceed one course, and at least one insert yarn out of the first to the Nth primary insert yarns is inserted to overlap with at least each of two insert yarns out of the first to the Nth secondary insert yarns when viewed from a thickness direction.

3. A knit structure of a warp knitted fabric comprising:

ground yarns constituting a ground structure by warp knitting; and a primary insert yarn group comprising first to Nth, wherein N is a natural number of not less than 2, primary insert yarns and a secondary insert yarn group comprising first to Nth secondary insert yarns, which are inserted along a warp direction in the ground structure to be knitted with the ground structure, thereby constituting an insertion structure, wherein the first to Nth primary insert yarns and the first to Nth secondary insert yarns are arranged side by side in a weft direction, wherein an nth, wherein n is a natural number of 1 to N, primary insert yarn and an nth secondary insert yarn, have respective, first portions knitted in the ground structure while becoming closer to each other in the warp direction, second portions knitted in the ground structure while becoming farther away from each other in the warp direction, and curved portions each of which connects the associated first portion and second portion, wherein the first portion, the second portion, and the curved portion of each insert yarn as a whole form a meandering shape, and wherein the primary insert yarn group and the secondary insert yarn group are inserted into the ground structure each time they proceed one course, and at least one insert yarn out of the first to the Nth primary insert yarns is inserted to overlap with at least each of two insert yarns out of the first to the Nth secondary insert yarns when viewed from a thickness direction.

4. A warp knitted fabric comprising:

ground yarns constituting a ground structure by warp knitting; and a primary knit yarn group comprising first to Nth, wherein N is a natural number of not less than 2, primary knit yarns and a secondary knit yarn group comprising first to Nth secondary knit yarns, which are knitted along a warp direction with the ground structure, thereby constituting a looping structure, wherein the first to Nth primary knit yarns and the first to Nth secondary knit yarns are arranged side by side in a weft direction, wherein an nth, wherein n is a natural number of 1 to N, primary knit yarn and an nth secondary knit yarn, have respective, first portions knitted in the ground structure while becoming closer to each other in the warp direction, second portions knitted in the ground structure while becoming farther away from each other in the warp direction, and curved portions each of which connects the associated first portion and second portion, wherein the first portion, the second portion, and the curved portion of each knit yarn as a whole form a meandering shape, and wherein the primary insert yarn group and the secondary insert yarn group are looped into the ground structure each time they proceed one course, and at least one insert yarn out of the first to the Nth primary insert yarns is looped to overlap with at least each of two insert yarns out of the first to the Nth secondary insert yarns when viewed from a thickness direction.

5. A method of manufacturing a warp knitted fabric, comprising:

a step of forming a ground structure by warp knitting of ground yarns and knitting first to Nth, wherein N is a natural number of not less than 2, primary knit yarns to constitute a primary knit yarn group and first to Nth secondary, knit yarns to constitute a secondary knit yarn group, each along a warp direction with the ground structure, thereby constituting a looping structure, wherein the first to Nth primary knit yarns and the first to Nth secondary knit yarns are arranged side by side in a weft direction, wherein an nth, wherein n is a natural number of 1 to N, primary knit yarn and an nth secondary knit yarn, have respective, first portions knitted in the ground structure while becoming closer to each other in the warp direction, second portions knitted in the ground structure while becoming farther away from each other in the warp direction, and curved portions each of which connects the associated first portion and second portion, wherein the first portion, the second portion, and the curved portion of each knit yarn as a whole form a meandering shape, and wherein the primary insert yarn group and the secondary insert yarn group are looped into the ground structure each time they proceed one course, and at least one insert yarn out of the first to the Nth primary insert yarns is looped to overlap with at least each of two insert yarns out of the first to the Nth secondary insert yarns when viewed from a thickness direction.

6. A knit structure of a warp knitted fabric comprising:

ground yarns constituting a ground structure by warp knitting; and a primary knit yarn group comprising first to Nth, wherein N is a natural number of not less than 2, primary knit yarns and a secondary knit yarn group comprising first to Nth secondary knit yarns, which are knitted along a warp direction with the ground structure, thereby constituting a looping structure, wherein the first to Nth primary knit yarns and the first to Nth secondary knit yarns are arranged side by side in a weft direction, wherein an nth, wherein n is a natural number of 1 to N, primary knit yarn and an nth secondary knit yarn, have respective, first portions knitted in the ground structure while becoming closer to each other in the warp direction, second portions knitted in the ground structure while becoming farther away from each other in the warp direction, and curved portions each of which connects the associated first portion and second portion, wherein the first portion, the second portion, and the curved portion of each knit yarn as a whole form a meandering shape, and wherein the primary insert yarn group and the secondary insert yarn group are looped into the ground structure each time they proceed one course, and at least one insert yarn out of the first to the Nth primary insert yarns is looped to overlap with at least each of two insert yarns out of the first to the Nth secondary insert yarns when viewed from a thickness direction.

* * * * *